US005329999A

United States Patent [19]

White et al.

[11] Patent Number: 5,329,999

[45] Date of Patent: Jul. 19, 1994

[54] ANNULAR SAFETY SYSTEM

[75] Inventors: Pat M. White, Carrollton, Tex.; Lewis D. Proctor, Marykirk, Scotland

[73] Assignee: Halliburton Company, Houston, Tex.

[21] Appl. No.: 71,166

[22] Filed: Jun. 3, 1993

[51] Int. Cl.[5] ..... E21B 34/00

[52] U.S. Cl. ..... 166/129

[58] Field of Search ..... 166/129-134, 166/319-324, 373, 381, 386, 387

[56] References Cited

U.S. PATENT DOCUMENTS

| | | | |
|---|---|---|---|
| 4,252,195 | 2/1981 | Fredd | 166/133 X |
| 4,271,903 | 6/1981 | Slagle, Jr. et al. | 166/129 |
| 5,022,427 | 6/1991 | Churchman et al. | 137/155 |
| 5,207,275 | 5/1993 | Strattan et al. | 166/129 X |

OTHER PUBLICATIONS

Offshore/Oilman, Oct., 1992, pp. 54 and 56, Annular Control System Provides Safety Margin In Gas-Lift Wells, Dwayne Leismer.

*Primary Examiner*—Thuy M. Bui

*Attorney, Agent, or Firm*—Tracy W. Druce; Monty L. Ross

[57] ABSTRACT

An annular safety system for a well produced by gas lift includes a packer, a landing nipple below the packer and an operating seal unit to which primary and secondary well tubings and a control line are connected. There is an inline valve in the secondary tubing and safety valve operated by the control line in a primary flow conduit in the operating seal unit. After the operating seal unit is inserted through the packer to automatically land and be locked in the landing nipple and the packer operated to anchor and seal in a well casing, flow passages are formed for conveying lift gas from the secondary tubing to around the landing nipple for lifted flow upward through the primary conduit and tubing. When the well is being produced by lift gas, and pressure in the control line is reduced purposely or by rupture of the control line, the safety valve operates to prevent upward lifted flow in the primary tubing. If lift gas pressure in the secondary tubing is reduced purposely or by rupture, the inline valve prevents upward flow. The operating seal unit may be unlocked from the landing nipple for retrieval from the packer and well.

19 Claims, 7 Drawing Sheets

ANNULAR SAFETY SYSTEM

BACKGROUND OF THE INVENTION (1) Technical Field

This invention pertains to a well system utilizing two flow conduits. The invention particularly pertains to a system useful in a well produced by gas lift for preventing flow of lift gas through a secondary well tubing to surface and production flow to surface through a primary well tubing.

(2) Background Information

Prior annular safety systems for gas lift wells utilized complicated and expensive assortments of packers, side-pocket mandrels, gas lift valves and safety valves. These annular safety system installations required pressurized gas or production in tubing casing annular flow passages with inaccessible safety valves positioned below one or two packers. Well servicing tools could not be lowered into some of the installations on wireline because of restrictions or abrupt offsets in the flow conduits. The annular safety system of this invention requires no gas lift valves, side pocket mandrels and only one packer. Pressurized lift gas or production does not flow in the tubing casing annulus. All safety valves used are above the only packer required and are easily retrievable. Full bore well tubings are utilized permitting wireline servicing tools to be lowered through the production tubing.

SUMMARY OF THE INVENTION

The annular safety system of this invention utilizes a packer which is hydraulically operable to anchor and seal in a well casing. Suspended below the packer is a landing nipple. Primary and secondary well tubings are connected to a dual head on a unique operating seal unit, which extends through the packer to releasably lock in the landing nipple. An inline valve in the secondary tubing above the dual head permits downward flow and prevents upward flow. The operating seal unit, which also operates the packer to anchor and seal in well casing, contains a primary flow conduit communicating with the primary well tubing and annular flow passages communicating with the secondary well tubing. The annular flow passages in the operating seal unit and flow passages through and around the packer conduct pressurized lift gas from the secondary tubing to around the landing nipple to comingle with liquid in the casing which is aerated to flow (lifted) upwardly in the primary tubing. The primary flow conduit includes a novel emergency connector disconnected by rotation and an hydraulically operable safety valve which may be operated to prevent upward flow through the primary conduit in the operating seal unit. When it is desirable to stop upward flow in the primary conduit and primary tubing, gas pressure in the secondary tubing is reduced and any upward flow is automatically prevented by the inline valve. The safety valve in the primary conduit is operated to close preventing upward flow of aerated liquid in the primary conduit and primary tubing.

The operating seal unit may be unlocked from the landing nipple for retrieval to surface by wireline operation or rotated to disconnect if it cannot be unlocked by wireline.

An object of this invention is to provide an annular safety system for a well produced by gas lift having primary and secondary tubings with a valve in each tubing for preventing upward flow.

An object of this invention is to provide an annular safety system for a well produced by gas lift which utilizes a retrievable operating seal unit having a primary flow conduit for production flow and annular flow passages for lift gas flow.

Another object of this invention is to provide an annular safety system for a gas lift well wherein the operating seal unit is inserted for locking and is released for retrieval by wireline operation.

Also an object of this invention is to provide an operating seal unit for an annular safety system for a gas lift well which includes an emergency disconnect operated by rotation.

Additional objects and benefits of the present invention will be apparent to those skilled in the art on studying the following detailed description along with the accompanying drawings.

DESCRIPTION OF THE PREFERRED EMBODIMENT

Figure 1A:
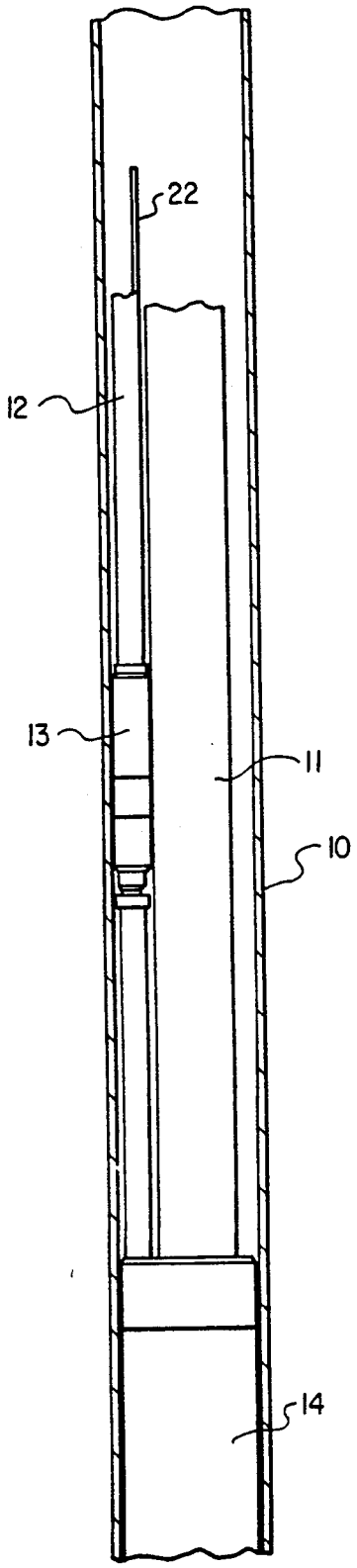
FIGS. 1A, B and C together are a schematic drawing in elevation and partial section of the annular safety system of this invention positioned in well casing before the packer has been operated to anchor in and seal with the casing.
Figure 1B:
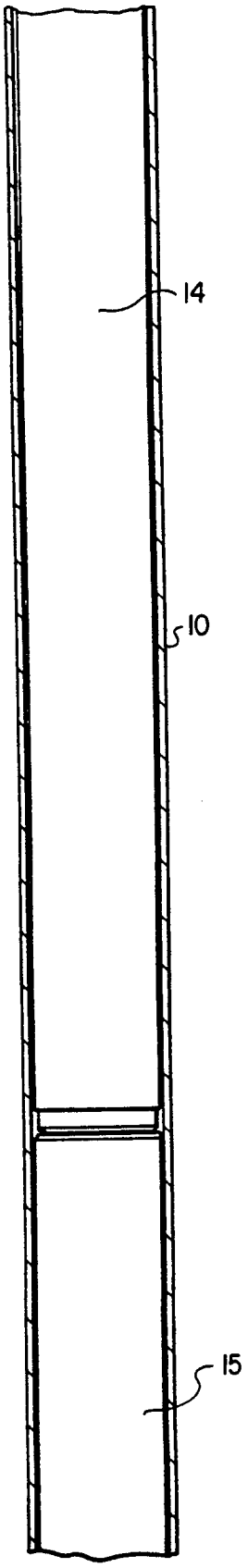
Figure 1C:
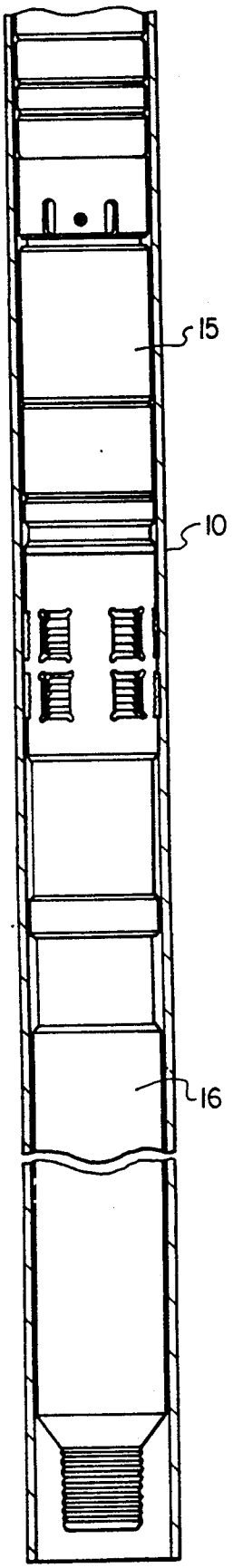
Figure 3:
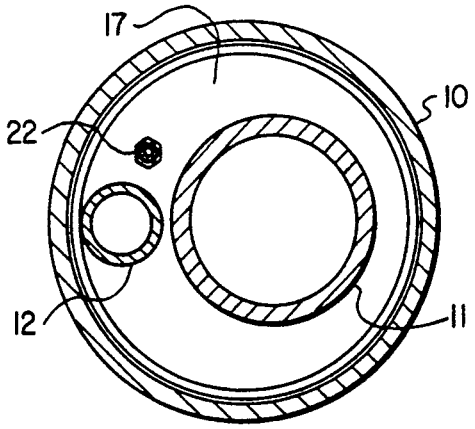
FIG. 3 is a drawing of the cross section along line 3—3 in FIG. 2.
Figure 4:
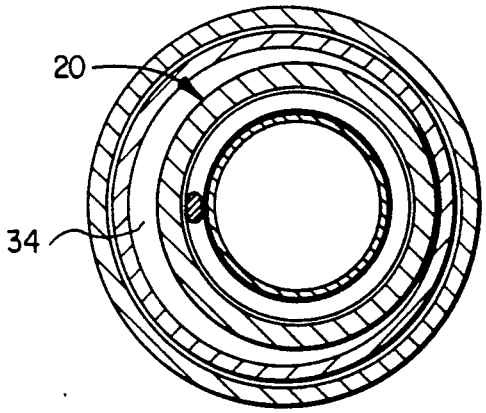
FIG. 4 is a cross sectional drawing along line 4—4 in FIG. 2.
Figure 2A:
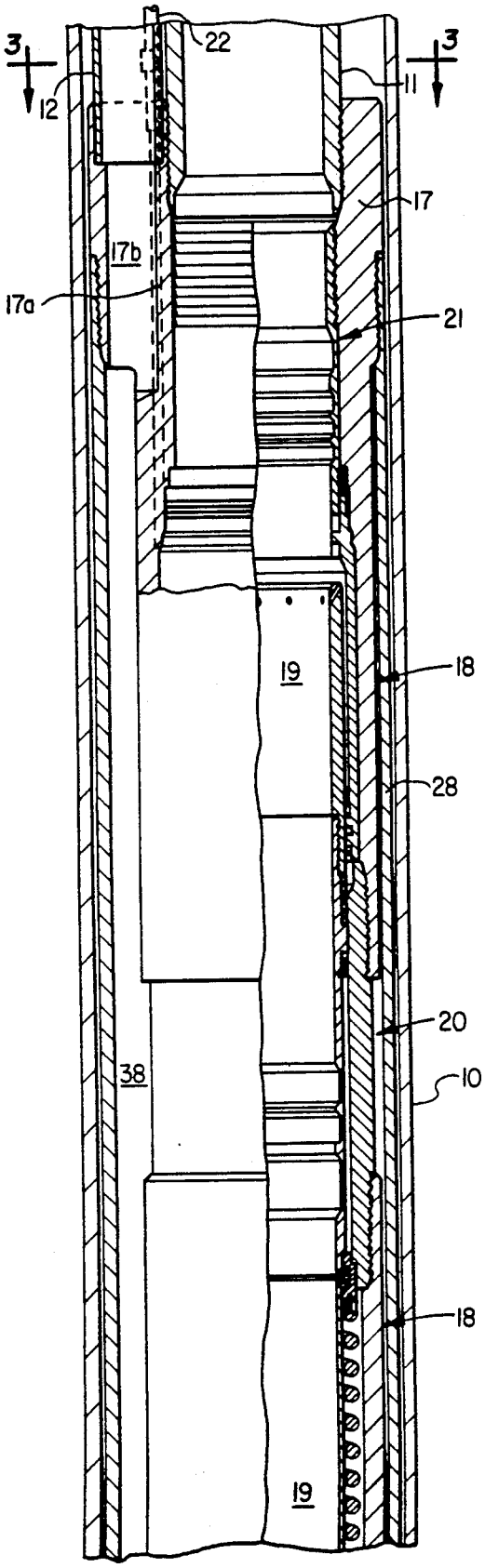
FIGS. 2A, B, C, D, E and F are a schematic drawing in elevation and partial section of the invention annular safety system positioned in well casing showing the packer anchored in well casing and the operating seal unit locked in the landing nipple below the packer.
Figure 2B:
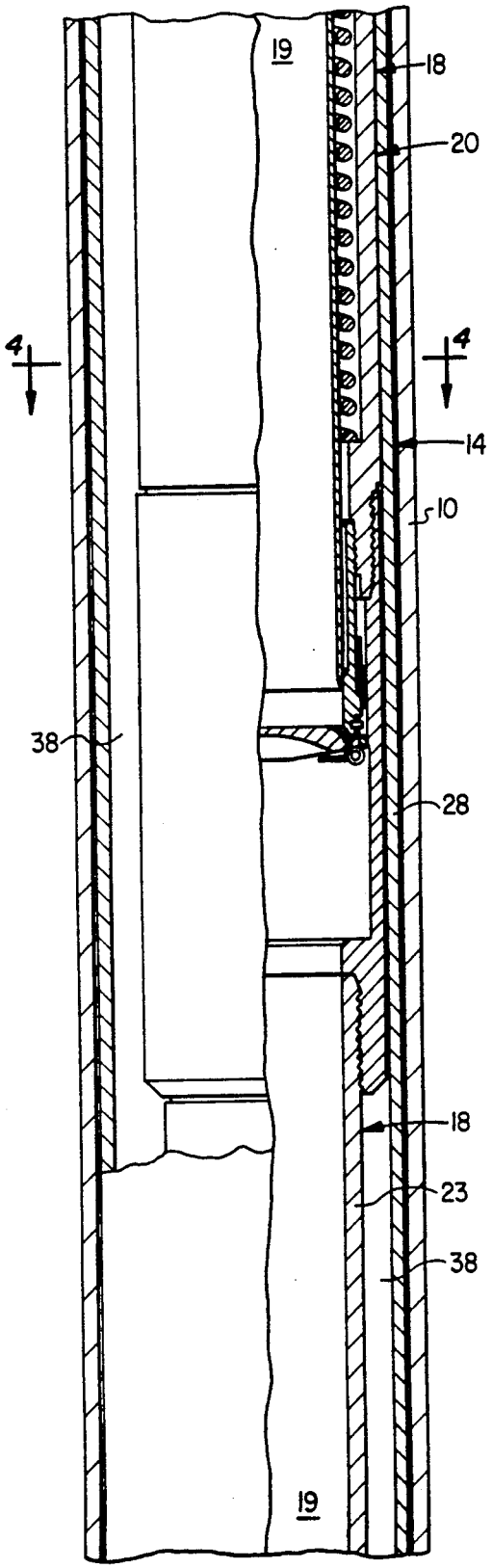
Figure 2C:
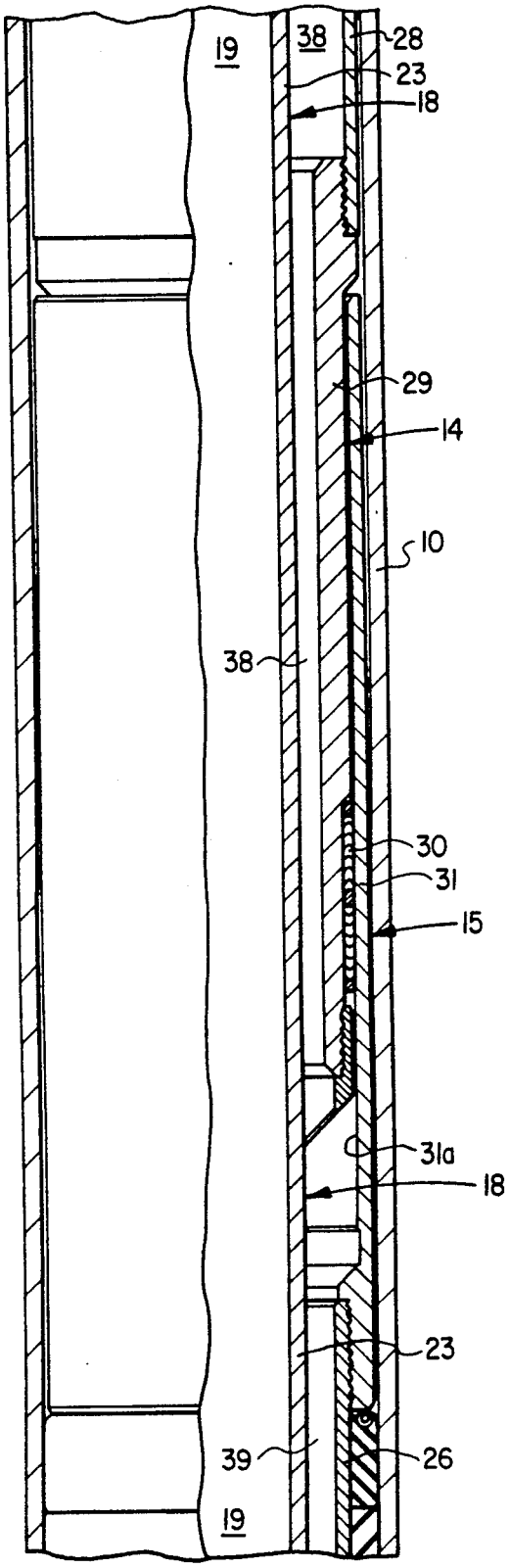
Figure 2D:
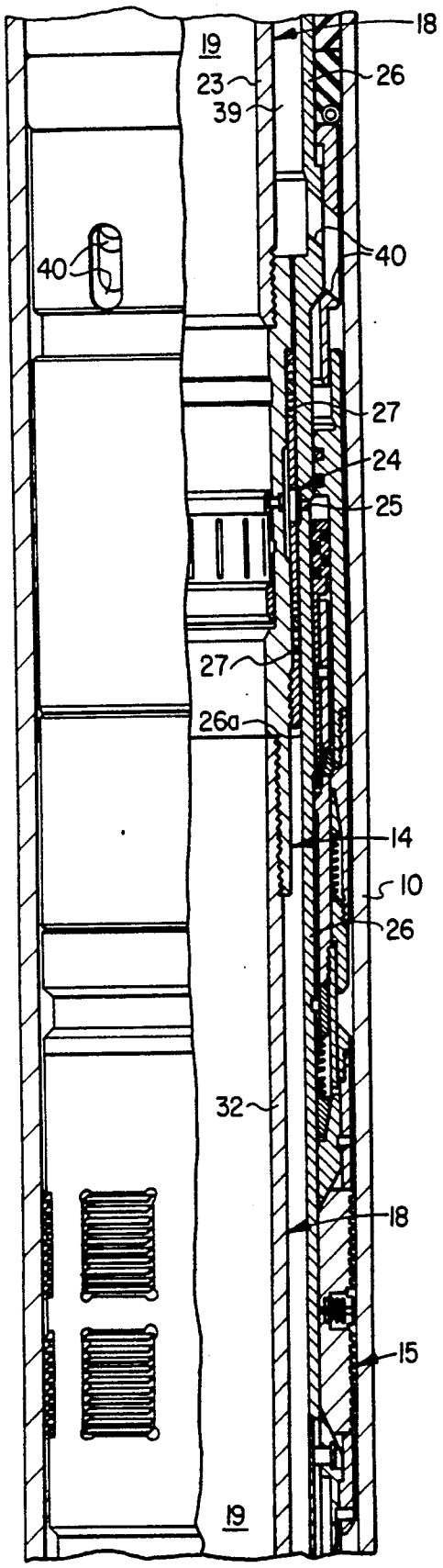
Figure 2E:
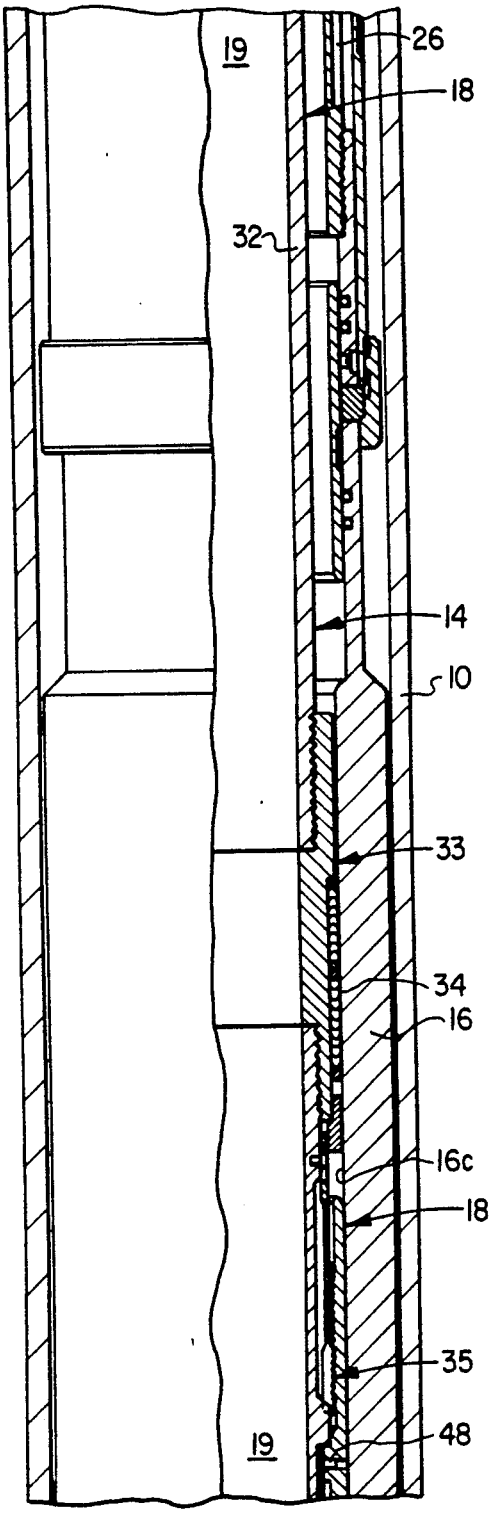
Figure 2F:
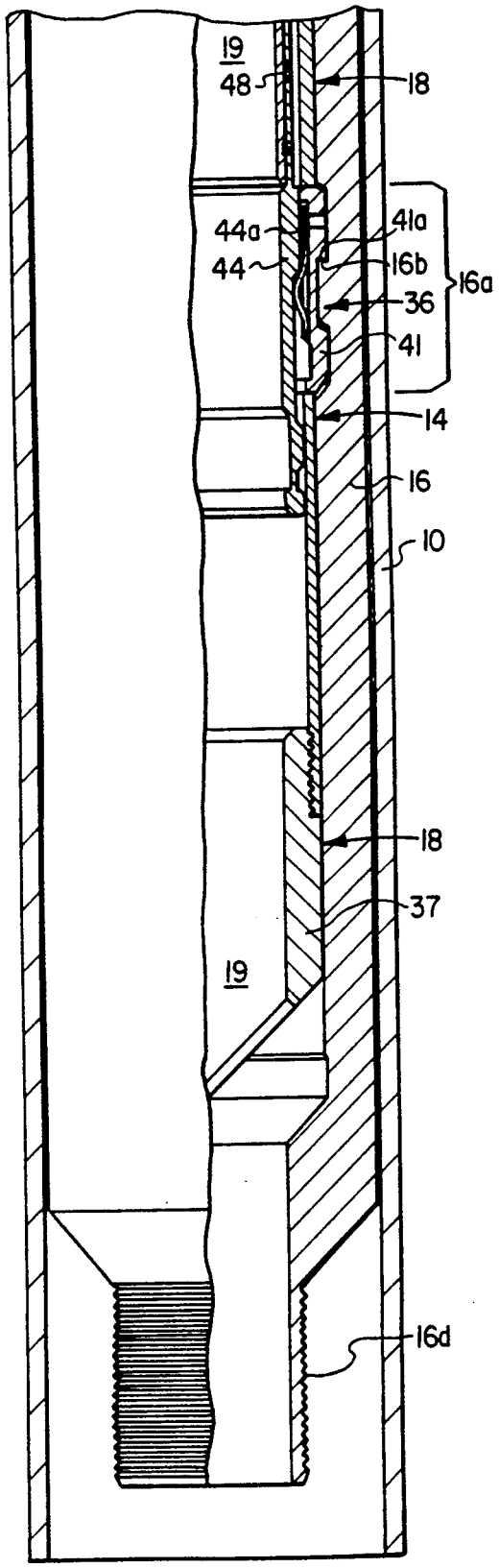

Shown in FIGS. 1A, B and C is the annular safety system of this invention positioned in well casing 10. The system includes a primary well tubing 11, a secondary well tubing 12 with an inline valve 13, both tubings are connected into an operating seal unit 14 and the operating seal unit sealingly engages the upper end of a packer 15. Connected below the packer is a landing nipple 16. FIG. 2 shows the landing nipple has profiled grooving 16*a*, a landing surface 16*b*, a seal bore 16*c* and a connector 16*d*. The primary and secondary tubings are connected into a dual head 17 on operating seal unit 14 (see also FIG. 3). Connected to the dual head and extending downwardly is a primary flow conduit 18 having a flow passage 19 in communication with the primary well tubing flow passage. A surface controlled subsurface safety valve 20 (see also FIG. 4) of the type disclosed in U.S. Pat. No. 4,723,606, issued 9 Feb., 1988 to Michael B. Vinzant et al is included in the primary flow conduit and shown in the closed position. The safety valve includes a lock out 21 for locking this safety valve in open position to permit two way flow through the primary flow conduit. Also connected to dual head 17 is a control line 22 from surface communicating through dual head flow passage 17*a* with safety valve 20 for operating the safety valve. Extending downwardly from the lower end of the safety valve is a spacer pipe 23 connected into a closed sleeve valve 24, which is sealed above and below operating flow ports 25 in lower packer mandrel 26 by resilient seals 27 engaging seal bore 26*a*.

An outer conduit 28 is connected on and extends downwardly from dual head 17 around safety valve 20 and connects to outer conduit extension 29 having resilient seals 30. Seals 30 sealingly engage seal bore 31*a* in upper packer mandrel 31 which is connected on lower packer mandrel 26. Spacer pipe 32 extends downwardly from sleeve valve 24 to connect to seal unit 33 having resilient seals 34 which are sealingly engageable in landing nipple seal bore 16*c* . Rotatable connector 35 and automatic lockable locator 36 are connected to seal unit 33 with guide 37 connected on lockable locator 36. FIG. 2 shows the lockable locator and operating seal unit have been inserted through the packer to automatically land and have been locked in landing nipple profiled grooving 16*a*.

In FIG. 2, outer conduit 28 and conduit extension 29 form an annular flow passage 38 with primary flow conduit 18. Flow passage 38 is in communication with dual head flow passage 17*b* (to secondary tubing 12) and annular flow passage 39 formed by spacer pipe 23 passing through upper and lower packer mandrels 31 and 26. Annular flow passage 39 is further in communication through outlet flow ports 40 with annular flow passages between the outside of the packer and well casing 10 to below landing nipple 16.

Figure 5A:
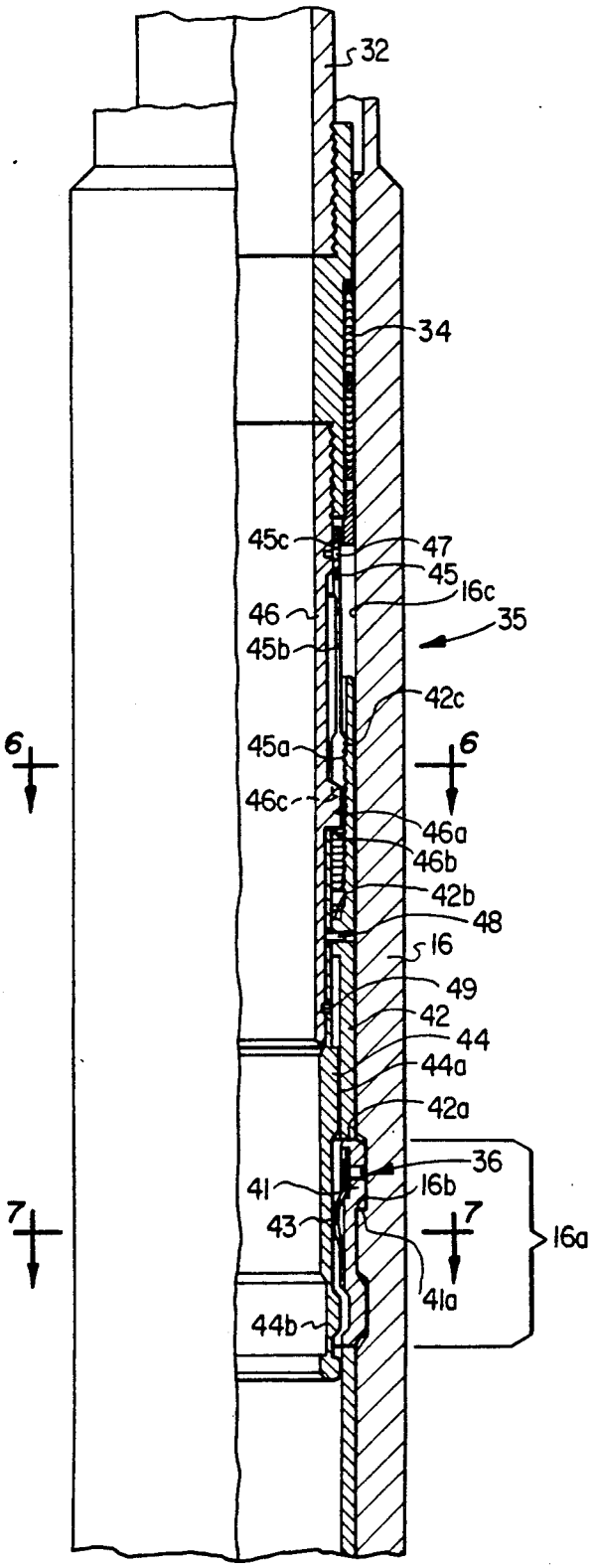
FIGS. 5A and 5B together is an elevational drawing in partial section of the lower portion of the operating seal unit showing the automatic lockable locator landed in the landing nipple.
Figure 5B:
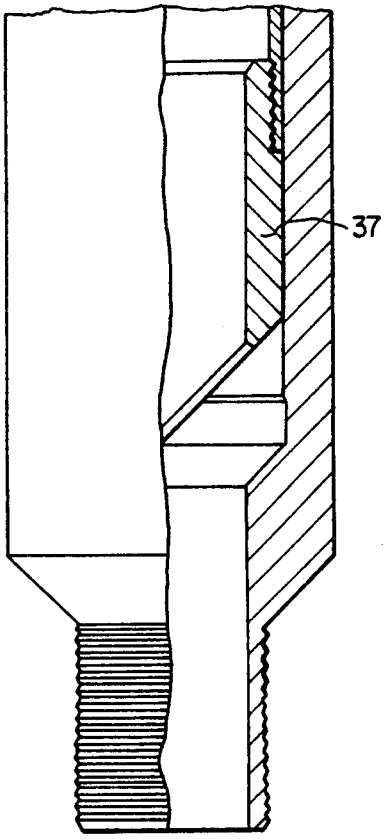

FIG. 5 shows the automatic lockable locator 36 connected to spacer pipe 32 by rotatable connector 35. Locator 36 has keys 41 which have landed in landing nipple profiled grooving 16*a* positioning operating seal unit 14 for operation in the invention annular safety system.

Figure 7:
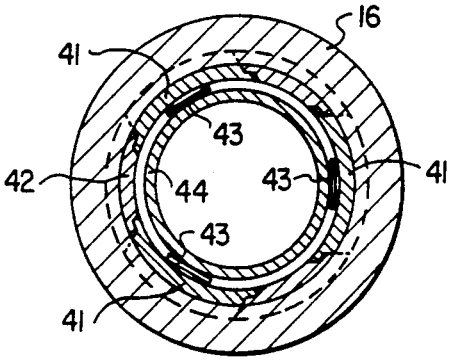
FIG. 7 is a drawing in cross section along line 7—7 of FIG. 5A.

Locator 36 has a housing 42 having a number of openings 42*a*. A key 41 is mounted for radial movement in each opening and each key is urged outwardly by a spring 43 mounted around longitudinally moveable sleeve 44 having expanding surface 44*a* and a profiled groove 44*b*,—see also FIG. 7.

Figure 6:
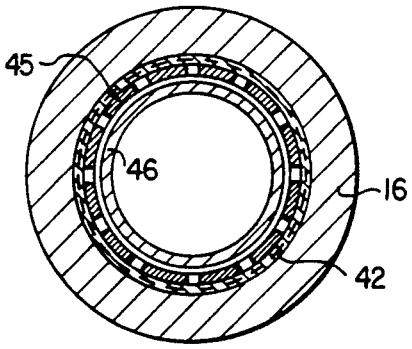
FIG. 6 is a cross sectional drawing along line 6—6 of FIG. 5A.

As shown in FIGS. 5 and 6, rotatable connector 35 is connected in upper housing threads 42*c* by mating threads 45*a* on fingers 45*b* of collet 45, which is positioned on collet mandrel 46 by bolts 47. Housing threads 42*c* and mating threads 45*a* are modified buttress in form. The collet mandrel has projections 46*a* extending between the collet fingers for rotating the collet latch when the operating seal unit and primary flow conduit 18 are rotated. There is a shoulder on each projection 46*b* engageable with a shoulder 42*b* in housing 42. The collet mandrel is also provided with a support surface 46*c* for engaging collet finger threads 45*a* in housing threads 42*c*.

FIG. 5 shows sleeve 44 is positioned in housing 42 by frangible pins 48 in a position where expander surface 44*a* is not inside keys 41 and the keys are radially moveable in openings 42*a*, permitting operating seal unit 14 and primary flow conduit 18 to be inserted into and moved downwardly in the packer until key surface 41*a* engages landing nipple profiled grooving landing surface 16*b*. Frangible pins 49 position collet mandrel 46 in sleeve 44.

Collet 45 is mounted around collet mandrel 46 and longitudinally moveable a small distance thereon as holes 45*c* in the collet are larger than bolts 47 positioning the collet on the collet mandrel. When collet mandrel 46 is moved downwardly through collet 45, shearing pins 48 and moving sleeve 44 downwardly in housing 42, threads 45*a* engaged in threads 42*c* hold the collet stationary until mandrel support surface 46*c* moves downwardly to a position not supporting the collet fingers and bolts 47 contact the lower edge of holes 45*c*. Continued downward movement of collet mandrel 46 and collet 45 repeatedly cams threads 45*a* inwardly from engagement with threads 42*c* to "ratchet" downwardly through threads 42*c* until shoulder 46*b* contacts shoulder 42*b* and expanding surface 44*a* is inside keys 41 locking locator 36 in landing nipple 16 as shown in FIG. 2 to prevent upward or downward movement of primary flow conduit and operating seal unit 14 in the landing nipple or packer.

To install the annular safety system of this invention in a cased well, sleeve 44 is positioned on collet mandrel 46 by installing pins 49 and in housing 42 of automatic lockable locator 36 by installing pins 48 as shown in FIG. 5. The packer with landing nipple only may be lowered into the well and operated to anchor and seal in the well casing at the proper depth. The operating seal unit may be lowered later on well tubing to seal, land and be locked in the landing nipple and seal in the packer or the operating seal unit may be installed to seal in the packer and locked in the landing nipple on surface for lowering together on well tubing to proper depth for operating the packer. To install the operating seal unit in the packer on surface for lowering together, operating seal unit 14 is inserted into packer 15, sealingly engaging seals 34 in seal bore 16*c*, seals 27 in seal bore 26*a* above and below operating flow ports 25 and seals 30 in packer mandrel seal bore 31*a* until key landing surfaces 41*a* engage landing surface 16*b* in landing nipple profiled grooving. The operating seal unit is moved downwardly in the packer to shear pins 48 and move expander surface 44*a* downwardly inside keys 41, locking the keys in landing nipple profiled groove 16*a* as shown in FIG. 2. The packer and operating seal unit are lowered to packer operating depth in the well on primary and secondary tubings connected to the operating seal unit with control line 22 alongside the tubings. On reaching packer operation depth, control line 22 is pressurized to open safety valve 20, flow passage 19 is plugged below sleeve valve 24, the sleeve valve is opened using wireline tools and pressurized fluid is introduced into primary tubing 11 to flow through operating flow ports 25 to operate the packer to anchor in and seal with well casing 10. The plug is removed from flow passage 19.

Liquid to be produced has risen in casing 10 around landing nipple 16 and into primary flow conduit passage 19. The well may now be produced by gas lift on increasing pressure in control line 22 to flow through dual head flow passage 17*a* into safety valve 20 and open the safety valve to permit flow upwardly in flow passage 19. Pressurized lift gas is introduced into secondary tubing 12 to flow downwardly through dual head flow passage 17*b* into annular flow passages 38 and 39 and outside packer 15 through outlet ports 40. Lift gas continues to flow downwardly around packer 15 through the annular flow area between the outside of packer 15, landing nipple 16 and the inside of casing 12 to below the landing nipple. Lift gas comingles with liquid in casing 10 around the landing nipple to aerate and lift the liquid upwardly through primary conduit flow passage 19, into primary tubing 11 and to surface.

If while producing the well by gas lift, the control line or secondary tubing is ruptured, the inline valve will prevent pressurized gas from flowing upwardly in the secondary tubing and reduction of pressure in the control line will permit safety valve 20 to close and prevent upward flow in the primary tubing.

Figure 8:
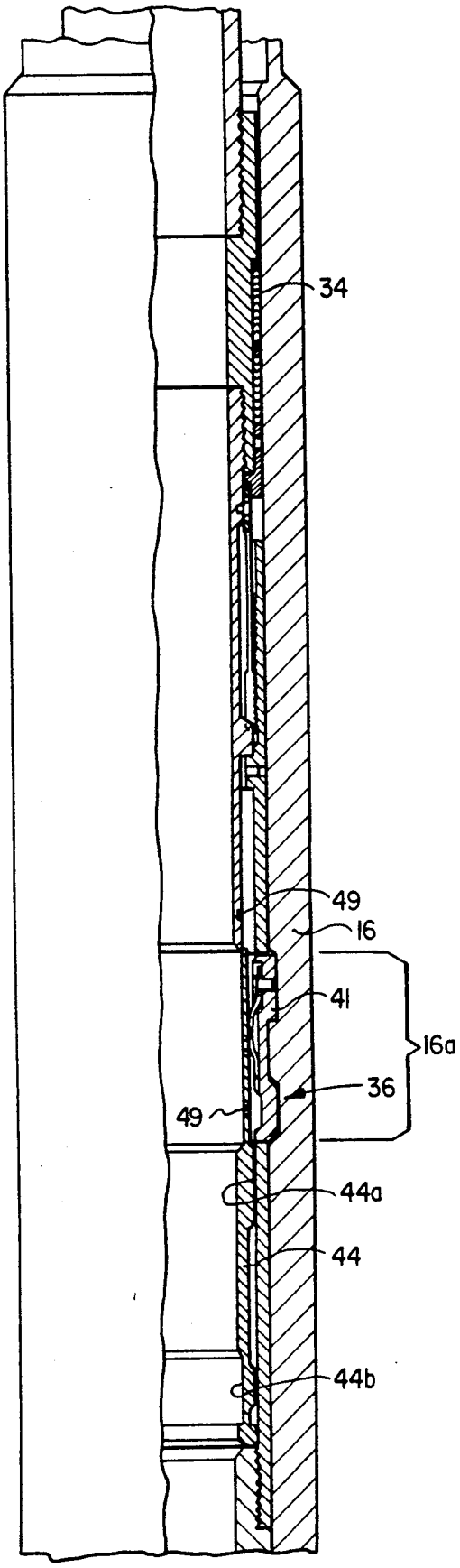
FIG. 8 is a drawing similar to FIGS. 5A & B showing the automatic lockable locator unlocked by wireline.

In the event it is desirable to cease gas lift production of the well and retrieve operating seal unit 14, lift gas flow down the secondary tubing is stopped and any upward flow in secondary tubing 12 is prevented by inline valve 13. Pressure is then decreased in control line 22 sufficiently to permit safety valve 20 to close, and prevent upward lifted flow in flow passage 19. A positioning tool (not shown) is lowered into lockable locator 36 on wireline to engage profiled grooving **44*b* in sleeve 44 and move the sleeve downwardly, shearing pins 49, to the position shown in FIG. 8. Sleeve expanding surface 44*a* has been moved from inside keys 41 unlocking the keys from landing nipple grooving 16*a*. The operating seal unit may be lifted to disengage keys 41 and seals 34 from landing nipple 16 and seals 27 and 30** from the packer mandrel. The operating seal unit may now be lifted further to surface.

It should be obvious to those skilled in annular safety valve art, that the operating seal unit would function to accomplish the objects and benefits of the present invention if it did not include rotatable connector 35.

If sleeve 44 cannot be moved to a not expanding position in lockable locator 36 by wireline or lifting the operating seal unit with sleeve 44 in not expanding position does not or cannot disengage keys 41 from landing nipple 16, an operating seal unit provided with a rotatable connector 35 can be rotated to disconnect from lockable locator 36 and permit operating seal unit 14 to be lifted from landing nipple 16 and packer 15 and further to surface.

Figure 9:
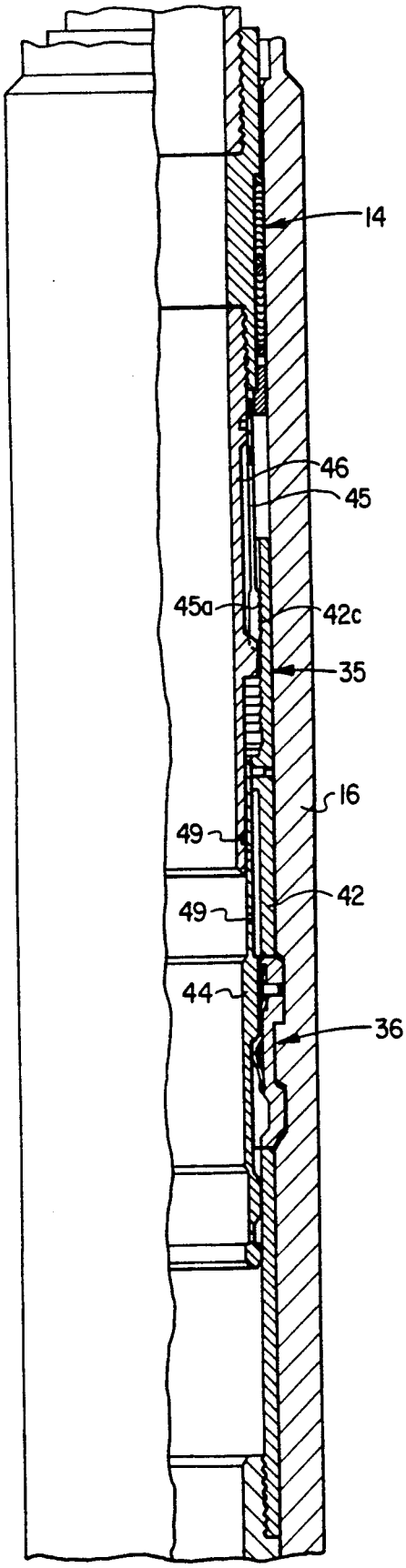
FIG. 9 is a drawing, also similar to FIGS. 5A & B, showing the rotatable connector being rotated to disconnect from the automatic lockable locator.

FIG. 9 shows a lifting force has been applied to the operating seal unit 14 while rotating the seal unit, Collet mandrel 46, collet 45 and sleeve 44 in housing 42 to move collet threads **45*a* upwardly in housing threads 42*c*. If sleeve 44 will not rotate, pins 49 will be sheared by rotation of collet mandrel 46 in sleeve 44 and the sleeve will not be moved upwardly in housing 42. If pins 49 are not sheared by rotation and sleeve 44 is moveable upwardly, it will move upwardly with mandrel 46**.

Continued lifting of the operating seal unit and rotation of collet threads **45*a* in housing threads 42*c* will disconnect the collet mandrel from housing 42 and release the collet mandrel and operating seal unit to be lifted from housing 42 and packer 15 to surface. If pins 49 have not been sheared, they will be sheared when the collet mandrel is lifted from housing 42**.

We claim:

1. An annular safety system for a cased well comprising:

(a) packer means for anchoring and sealing in said casing, said packer means having outlet ports for flow from inside to outside said packer means;

(b) a landing nipple connected below said packer means; and (c) operating seal unit means for operating said packer means to anchor and seal in said casing, said operating seal unit means sealingly engaging and extending through said packer means to form an annular flow passage communicating with said packer means outlet ports, said operating seal unit means including:

a dual head having primary and secondary well tubing connected thereto, a valve permitting downward flow and automatically preventing upward flow in said secondary well tubing, a primary flow conduit therein connected to said dual head and having a flow passage communicating said primary tubing through said landing nipple with said well casing below said packer means, said primary flow conduit having a safety valve therein operable to prevent upward flow in said primary conduit, lockable locator means on said primary flow conduit for landing and releasably locking in said landing nipple, and annular flow passages therein for communicating said secondary tubing with said annular flow passage through said packer means.

2. The annular safety system of claim 1 wherein the operating seal unit means further include means connecting the lockable locator means to the operating seal unit means, said connecting means disconnectable on rotation of said operating seal unit means in said lockable locator means.

3. The annular safety system of claim 1 wherein the dual head includes a flow passage therethrough for communicating control line pressure into the primary conduit safety valve.

4. The annular safety system of claim 1 wherein the landing nipple includes a seal bore and profiled grooving in which the lockable locator means may land and be locked.

5. The annular safety system of claim 1 wherein the packer means further includes an upper mandrel having a seal bore therein above the outlet flow ports connected to a lower mandrel having a seal bore therein below said outlet ports, said lower mandrel including operating flow ports therethrough below said outlet ports.

6. The annular safety system of claim 5 wherein the primary flow conduit includes seals thereon for sealingly engaging the landing nipple seal bore and the lower packer mandrel seal bore above and below the operating flow ports.

7. The annular safety system of claim 6 wherein the primary flow conduit further includes a sleeve valve therein between the seals engaging the lower packer mandrel above and below the operating flow ports.

8. The annular safety system of claim 5 wherein the operating seal unit further includes an outer conduit around the primary flow conduit connected to the dual head, said outer conduit having seals thereon for sealingly engaging the upper packer mandrel seal bore.

9. The annular safety system of claim 4 wherein the lockable locator means comprises:

(a) a housing having openings therethrough;

(b) a key mounted for radial movement in each opening, each said key having profiled grooving engageable in the landing nipple profiled grooving;

(c) a longitudinally moveable sleeve mounted in said housing said sleeve having an expander surface thereon;

(d) spring means between said sleeve and each key; and (e) releasable means for positioning said sleeve in a first upper position in said housing where said expander is not expanding said keys; said sleeve releasable by downward movement to a second position expanding said keys and further downward to a third position not expanding said keys.

10. The annular safety system of claim 9 wherein the landing nipple profiled grooving and lockable locator key profiled grooving each include engageable landing surfaces.

11. The annular safety system of claim 4 wherein the connecting means is cooperable with and housed in the lockable locator means, said connecting locator means comprising:

(a) a housing having openings therethrough and threads therein, (b) a key mounted for radial movement in each opening, each said key having profiled grooving engageable in the landing nipple profiled grooving;

(c) a longitudinally moveable sleeve mounted in said housing, said sleeve having an expander surface thereon;

(d) spring means between said sleeve and each key;

(e) releasable means for positioning said sleeve in said housing in a first upper position where said expander is not expanding said keys, said sleeve releasable by downward movement to a second position expanding said keys and moveable further downwardly to a third position not expanding said keys;

(f) a collet mandrel releasably connected in said sleeve; and (g) a collet mounted around said collet mandrel and positioned thereon, said collet having fingers, and each said finger having threads engageable in said housing threads.

12. The annular safety valve of claim 11 wherein the connecting locator collet mandrel further includes projections therefrom extending between the collet fingers and a supporting surface thereon for supporting the collet finger threads engaged in the housing threads.

13. An annular safety system for a cased well comprising:

(a) packer means for anchoring and sealing in said casing, said packer means having outlet ports for flow from inside to outside said packer means;

(b) a landing nipple having profiled grooving therein connected below said packer means; and (c) operating seal unit means for operating said packer means to anchor and seal in said casing, said operating seal unit means sealingly engaging and extending through said packer means to form an annular flow passage communicating with said packer means outlet ports, said operating seal unit means including:

a dual head having primary and secondary well tubing connected thereto, a valve permitting downward flow and automatically preventing upward flow in said secondary well tubing, a primary flow conduit therein connected to said dual head and having a flow passage communicating said primary tubing through said landing nipple with said well casing below said packer means, said primary flow conduit having a safety valve therein operable to prevent upward flow in said primary conduit, lockable locator means on said primary flow conduit for landing and releasably locking in said landing nipple, and said lockable locator means including, a housing having openings therethrough, a key mounted for radial movement in each opening, each said key having profiled grooving engageable in said landing nipple profiled grooving, a longitudinally moveable sleeve in said housing releasably connected on said primary flow conduit, said sleeve having an expander surface thereon, spring means between said sleeve and each key, releasable means for positioning said sleeve in a first upper position in said housing where said expander is not expanding said keys, said sleeve releasable by downward movement to a second position expanding said keys and further downward to a third position not expanding said keys, and annular flow passages therein for communicating said secondary tubing with said annular flow passage through said packer means.

14. An annular safety system for a cased well comprising:

(a) packer means for anchoring and sealing in said casing, said packer means having outlet ports for flow from inside to outside said packer means;

(b) a landing nipple having profiled grooving therein connected below said packer means; and (c) operating seal unit means for operating said packer means to anchor and seal in said casing, said operating seal unit means sealingly engaging and extending through said packer means to form an annular flow passage communicating with said packer means outlet ports, said operating seal unit means including:

a dual head having primary and secondary well tubing connected thereto, a valve permitting downward flow and automatically preventing upward flow in said secondary well tubing, a primary flow conduit therein connected to said dual head and having a flow passage communicating said primary tubing through said landing nipple with said well casing below said packer means, said primary flow conduit having a safety valve therein operable to prevent upward flow in said primary conduit, connecting locator means on said primary flow conduit for landing and releasably locking in said landing nipple, said connecting locator means disconnectable on rotation of said operating seal unit means if said connecting locator cannot be released from said landing nipple, said connecting locator means including, a housing having openings therethrough and threads therein, a key mounted for radial movement in each opening, each said key having profiled grooving engageable in said landing nipple profiled grooving, a longitudinally moveable sleeve mounted in said housing, said sleeve having an expander surface thereon, spring means between said sleeve and each key, releasable means for positioning said sleeve in said housing in a first upper position where said expander is not expanding said keys, said sleeve releasable by downward movement to a second position expanding said keys and moveable further downwardly to a third position not expanding said keys, a collet mandrel releasably connected in said sleeve, a collet mounted around said collet mandrel and positioned thereon, said collet having fingers, and each said finger having threads engageable in said housing threads, and annular flow passages therein for communicating said secondary tubing with said annular flow passage through said packer means.

15. The annular safety system of claim 14 wherein the connecting locator collet mandrel further includes projections therefrom extending between the collet fingers and a supporting surface thereon for supporting the collet finger threads engaged in the housing threads.

16. A connecting locator for landing and releasably locking in profiled grooving in a well conduit comprising:

(a) a housing having openings therethrough and threads therein;

(b) a key mounted for radial movement in each opening, each said key having profiled grooving engageable in said conduit profiled grooving;

(c) a longitudinally moveable sleeve mounted in said housing, said sleeve having an expander surface thereon;

(d) spring means between said sleeve and each key;

(e) releasable means for positioning said sleeve in said housing in a first upper position where said expander is not expanding said keys, said sleeve releasable by downward movement to a second position expanding said keys and moveable further downwardly to a third position not expanding said keys;

(f) a collet mandrel releasably connected in said sleeve; and (g) a collet mounted around said collet mandrel and positioned thereon, said collet having fingers, and each said finger having threads engageable in said housing threads.

17. The connecting locator of claim 16 wherein the collet is positioned on the collet mandrel for limited longitudinal movement therewith.

18. The connecting locator of claim 16 wherein the key profiled grooving and the landing nipple profiled grooving each include engageable landing surfaces.

19. The connecting locator of claim 16 wherein the collet mandrel further includes projections therefrom extending between the collet fingers and a supporting surface thereon for supporting the collet finger threads engaged in the housing threads.

* * * * *